US005357565A

United States Patent [19]

Butler, III et al.

[11] Patent Number: 5,357,565

[45] Date of Patent: Oct. 18, 1994

[54] HINGE SHIELD FOR NETWORK INTERFACE ENCLOSURE

[75] Inventors: Walter K. Butler, III, Sebago Lake; James G. Beahm, Cumberland; Thomas H. Blaisdell, Cape Neddick, all of Me.

[73] Assignee: Siecor Puerto Rico, Inc., Hickory, N.C.

[21] Appl. No.: 990,998

[22] Filed: Dec. 16, 1992

[51] Int. Cl.[5] ..... E05D 11/00

[52] U.S. Cl. ..... 379/412; 379/399; 16/250; 16/251

[58] Field of Search ..... 379/412, 399, 437, 442; 16/380, 117, 250, 251, 261, 267, 356, 377, 380, DIG. 13, 254; D8/323-329

[56] References Cited

U.S. PATENT DOCUMENTS

| | | | |
|---|---|---|---|
| D. 287,583 | 1/1987 | Smith et al. | 379/399 |
| D. 328,127 | 7/1992 | Smith, Jr. | D8/326 |
| 2,585,836 | 2/1952 | Quigley | 16/250 |
| 3,021,555 | 2/1962 | Hogedal | 16/261 |
| 3,295,714 | 1/1967 | Di Addorio | 16/267 |
| 3,928,890 | 12/1975 | Baker, Sr. | 16/227 |
| 4,349,120 | 9/1982 | DiNardo | 16/267 |
| 4,488,008 | 12/1984 | Dellinger et al. | 179/81 |
| 4,624,514 | 11/1986 | Smith | 379/412 |
| 4,723,919 | 2/1988 | Crane | 439/521 |
| 4,741,032 | 4/1988 | Hampton | 379/399 |
| 4,749,359 | 6/1988 | White | 439/133 |
| 4,800,588 | 1/1989 | Poster, Jr. | 379/412 |
| 4,853,960 | 8/1989 | Smith | 379/437 |
| 4,860,350 | 8/1989 | Smith | 379/412 |
| 4,873,745 | 10/1989 | Ramsauer | 16/261 |
| 4,910,770 | 3/1990 | Collins et al. | 379/399 |
| 4,945,559 | 7/1990 | Collins et al. | 379/399 |
| 4,949,376 | 8/1990 | Nieves et al. | 379/399 |
| 4,979,209 | 12/1990 | Collins et al. | 379/399 |
| 5,145,388 | 9/1992 | Brownlie et al. | 379/442 |
| 5,146,650 | 9/1992 | Robertson | 16/267 |
| 5,153,910 | 10/1992 | Mickelson et al. | 379/399 |
| 5,153,911 | 10/1992 | Smith | 379/412 |
| 5,224,240 | 7/1993 | Smith et al. | 16/250 |
| 5,231,732 | 8/1993 | Knoop et al. | 16/267 |

FOREIGN PATENT DOCUMENTS

| | | | |
|---|---|---|---|
| 1459064 | 11/1968 | Fed. Rep. of Germany | 16/250 |
| 1219725 | 5/1960 | France | 16/261 |
| 2623553 | 5/1989 | France | 16/261 |

OTHER PUBLICATIONS

Keptel, Inc., brochure for the SNI®-4600 Network Interface System, Feb. 1988.

Keptel, Inc., brochure for the SNI®-4600 Network Interface System, Oct. 1991.

GTE Products Corporation, brochure for the Sylvania Control Devices CP-765 Network Interface Device, printed Jun. 1987.

GTE Products Corporation, brochure for the Sylvania Control Devices CP-761 Network Interface Device, printed Sep. 1989.

*Primary Examiner*—James L. Dwyer
*Assistant Examiner*—Scott L. Weaver
*Attorney, Agent, or Firm*—J. David Abernethy

[57] ABSTRACT

A telephone network interface enclosure comprises a base and hinge pin integrally molded together as one piece. The enclosure includes a cover and hinge hooks also integrally molded together as one piece. The hinge pin and hinge hooks fit together to form a hinge. There is a hinge shield which, together with the hinge hooks, substantially totally cover the hinge pin.

5 Claims, 5 Drawing Sheets

2
3
4
1
5

HINGE SHIELD FOR NETWORK INTERFACE ENCLOSURE

BACKGROUND OF THE INVENTION

This invention concerns telephone network interface enclosures. Such enclosures are shown in U.S. Pat. Nos. 4,749,359, 4,800,588, 4,910,770, 4,945,559, 4,949,376 and 5,153,910, the disclosures of which are incorporated herein by reference. The enclosures include terminals to which a telephone subscriber's wiring can be connected.

Enclosures of network interface devices are generally made of either metal or plastic. Of the plastic variety there are found enclosures with removable covers and those with hinged covers. It is an object of this invention to resolve one of the problems inherent with hinges of the plastic enclosures.

Commonly, a plastic hinged cover network interface enclosure utilizes modern molding techniques to form the hinge as two complementary geometries. The two are held together by way of a plastic molded snap fit design which allows relative rotation. Furthermore, the plastic molding process allows the halves of the hinge to be integrally molded as a feature of other components and thereby minimizes the total number of parts required to manufacture a complete enclosure.

Typically, one half of the hinge geometry is found to be a pin, cylindrical in shape, integrally molded as a part of the base of the enclosure. The cover of the enclosure contains geometry complementary in shape to the pin and is semi-tubular in shape. The complementary portion of this geometry is its interior surface which can be found to encompass anywhere from 190 to 300 degrees of the pin's circumference. This is unlike other common hinges in which the pin of the hinge is entirely concealed, such as a metallic piano hinge.

The problem with molded hinges as above described is that the pin is left partially exposed and is susceptible to accumulation of foreign material. This foreign material can impede the smooth, proper function of the hinge over time. Of greater concern is the build-up of paint or stain on this exposed portion of the pin. This build-up can act as a barrier as well as a bonding agent. Both can prove to be a restriction to the rotation of the hinge which at times results in the destruction of the joint.

The benefits to manufacturers who use this plastic molded, snap fit hinge design are great. It allows economy of parts and simplicity of assembly while fully utilizing standard injection molding techniques. That is to say that no special motion in the tool is required to create the hinge members. This design provides the manufacturer a cost effective means to obtain a desirable feature. Additionally, the buyers of these products view a hinged cover as an important if not a required feature as it minimizes the possibility of losing or misplacing the cover.

Manufacturers who use this type of hinge and recognize its benefits as well as its short comings have tried a variety of ideas in hopes of reducing the potential for destructive damage to their product. One common approach has been to construct the hinge members substantially larger than the hinging function would require in the absence of obstruction or bonding agents. The perception is that a larger hinge is a stronger hinge. Others have tried arranging the hinge geometry so that an obstruction causes the snap fit joint between the cover and the base to decouple non-destructively. While this method may prevent damage, it is viewed as an inconvenience. Still others arrange the geometry in efforts to minimize the exposed area of the pin. The nature of plastic materials and molding processes limit the degree to which this last method is effective.

SUMMARY OF THE INVENTION

This invention discloses a hinge design in which the open area of the hinge pin is substantially completely covered by the introduction of a third element, specifically, a hinge shield. The purpose of the hinge shield is to protect the integrity of the pivotal surface interface of the hinge. The hinge effectively prevents build up of foreign substances, for example, paint, which could prove detrimental to hinge performance.

This invention discloses a telephone network interface enclosure comprising a base having a hinge pin, a cover having hinge hooks, and a hinge shield. The base and hinge pin have been integrally molded as one piece, as have, also, the cover and the hinge hooks. The geometry of the hinge hooks can be complementary to the hinge pin. In one embodiment, the hinge shield is complementary in shape to both the hinge pin and the hinge hooks, so that when the hinge hooks and the hinge shield are nested in place on the hinge pin, the combination of the hinge hooks and the hinge shield substantially totally surround the hinge pin.

DETAILED DESCRIPTION

Figure 1:
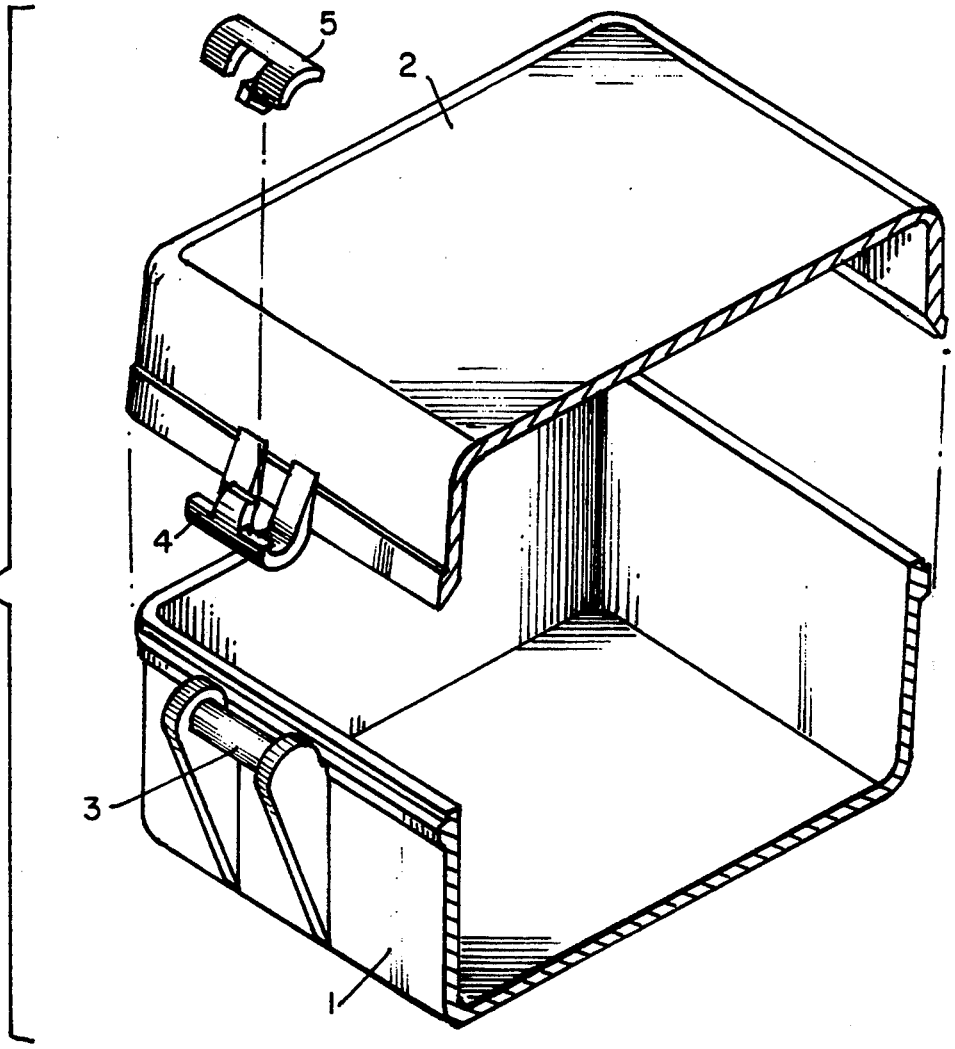
FIGS. 1 and 2 show telephone network interface enclosures with one hinge shield embodiment.

As shown in FIG. 1, the enclosure comprises a base 1 and a mating cover 2. Base 1 has a hinge pin 3 thereon, base 1 and hinge pin 3 being integrally molded as one piece. Cover 2 has a hinge hook 4 thereon, cover 2 and hinge hook 4 being integrally molded as one piece. Cover 2 can be attached to base 1 by fitting hinge hook 4 onto hinge pin 3. The enclosure includes a hinge shield 5 which is complementary in shape to both hinge pin 3 and hinge hook 4. When hinge shield 5 is fitted onto hinge pin 3, it covers the part of hinge pin 2 that is left exposed by hinge hook 4. The combination of hinge hook 4 and hinge shield 5 form a complete tubular shape which substantially totally surrounds hinge pin 3.

Hinge shield 5 can be attached to the hinge assembly by different methods. A preferred method is to mold shield 5 with a snap fit design such that the shield is installed by snapping it onto hinge pin 3. Shield 5 would be free to rotate about pin 3. No further attachment would be necessary. Further, shield 5 could be added after assembly of the remainder of the hinge was complete. This is significant in that network interface devices currently in use could be upgraded to this improved design with minimal efforts. Telephone company personnel, at their next visit to the site of installation of a network interface device, could add a shield 5 to each hinge without disassembling the device.

In a preferred embodiment, shield 5 permits removal and replacement of cover 2 of the network interface device without removing the shield. Replacement of cover 2 may be necessary if the cover encounters sufficient impact to cause damage. It is desirable to be able to replace a damaged cover rather than replace the entire device. The ability to remove the cover without first removing the shield, and the ability to replace the cover with the shield in place, make this embodiment preferable over others.

Figure 2:
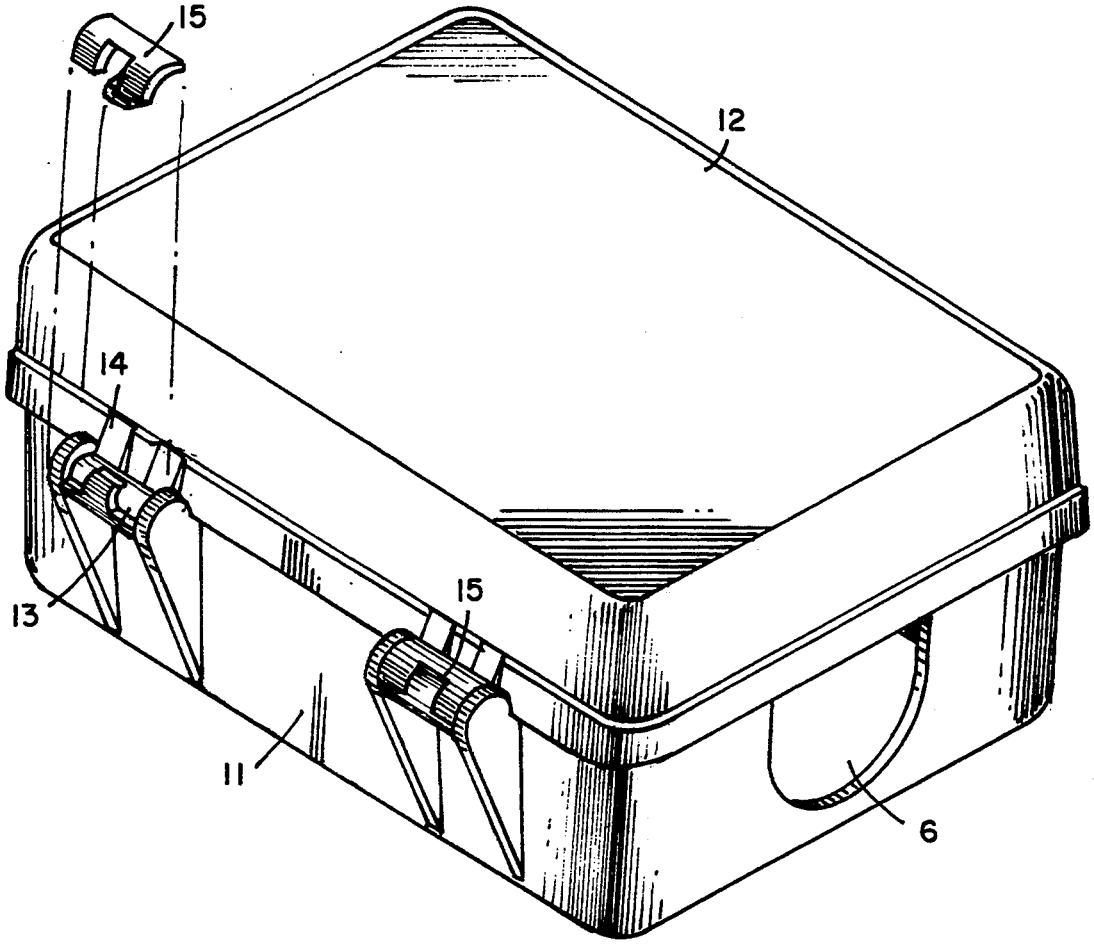

FIG. 2 shows a similar embodiment. The enclosure comprises base 11, mating cover 12, two hinge pins 13, two hinge hooks 14 and two hinge shields 15. In addition, the enclosure has a hole 6 to accommodate telephone wires, for example, telephone company wires and/or telephone subscriber wires. The telephone subscriber wires would be connected to terminals within the enclosure.

Figure 3:
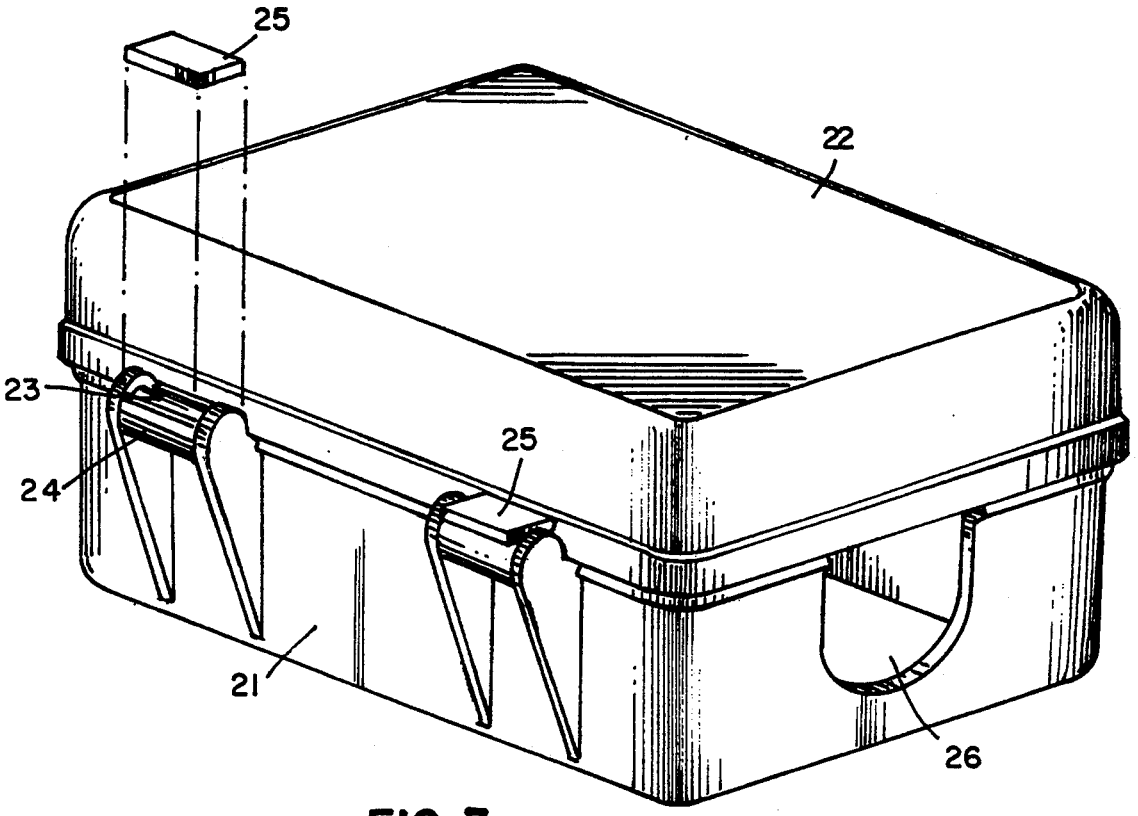
FIGS. 3, 4 and 5 show another embodiment.
Figure 4:
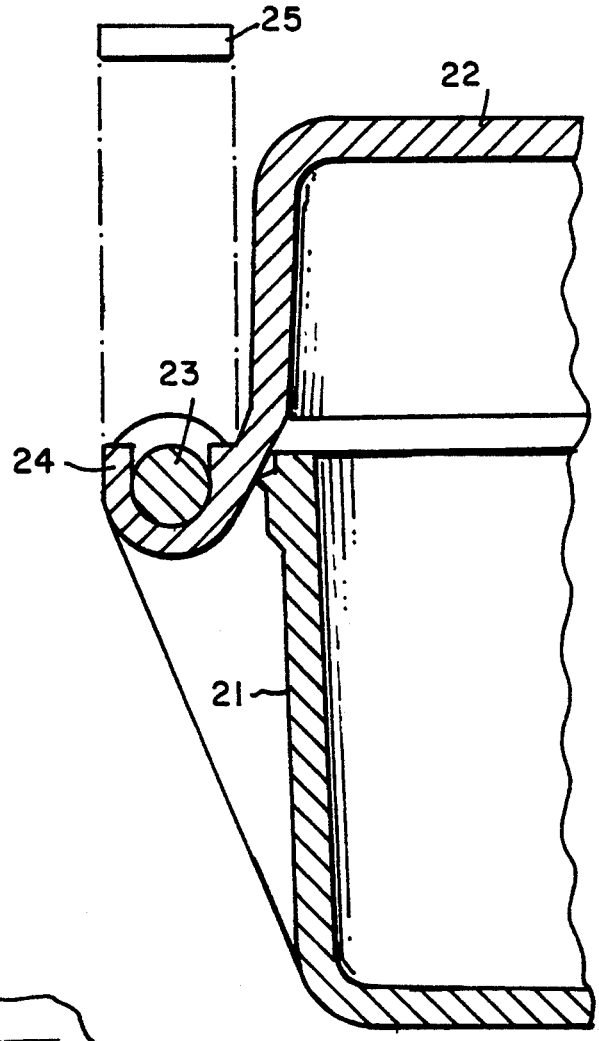
Figure 5:
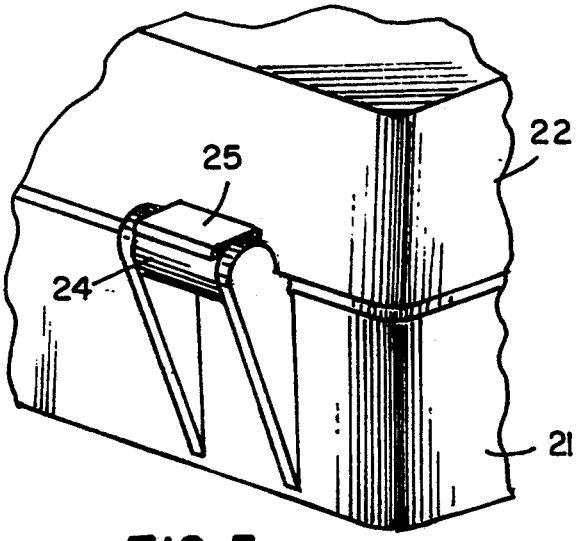

In FIGS. 3, 4 and 5 the enclosure is similar to that of FIG. 2, but the hinge shield is different. The enclosure comprises base 21, mating cover 22, two hinge pins 23, two hinge hooks 24, two hinge shields 25 and hole 26. Hinge shield 25 fastens to hinge hooks 24, instead of being attached to hinge pin 23. After hinge hooks 24 and hinge pin 23 have been nested together, hinge shield 25 can be fastened to hinge hooks 24 by, for example, adhesives, welding or screws.

Figure 6:
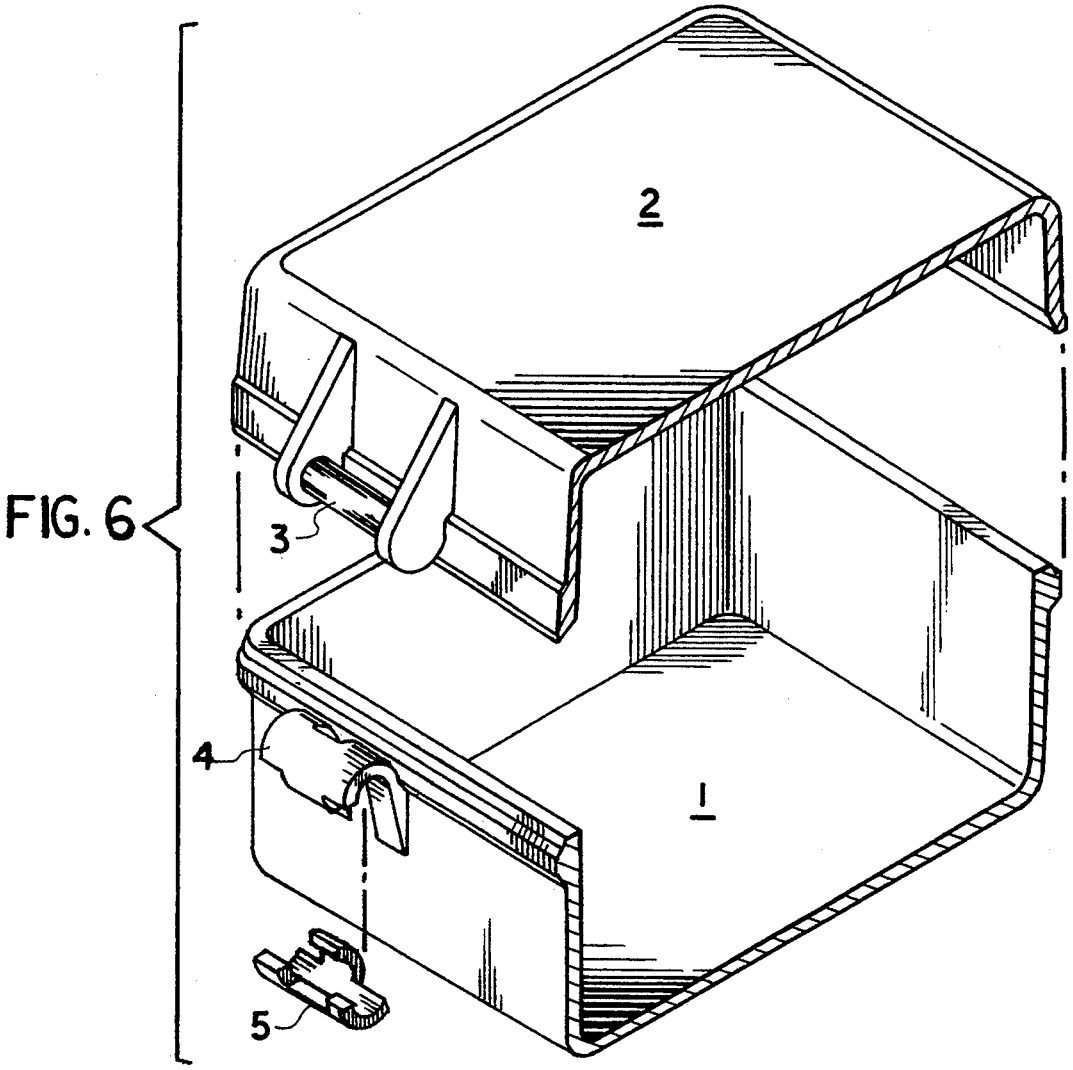
FIG. 6 shows another embodiment of the enclosure.

In an alternative embodiment, the hinge pin could be molded as part of the cover and the hinge hook could be molded as part of the base. This alternative embodiment is shown in FIG. 6.

We claim:

1. A telephone network interface enclosure comprising: a base having a hinge pin, the base and hinge pin having been integrally molded as one piece; a cover having a hinge hook, the geometry of the hinge hook being complementary to the hinge pin, the cover and hinge hook having been integrally molded as one piece; and a hinge shield attached to the hinge pin, the combination of the hinge shield and hinge hook substantially totally covering the hinge pin.

2. The telephone network interface enclosure of claim 1 comprising, in addition, a hole through the enclosure to accomodate telephone wires.

3. The telephone network interface enclosure of claim 1 wherein the hinge shield is a snap fit on the hinge pin.

4. A telephone network interface enclosure comprising: a cover having a hinge pin, the cover and hinge pin having been integrally molded as one piece; a base having a hinge hook, the geometry of the hinge hook being complementary to the hinge pin, the base and hinge hook having been integrally molded as one piece; and a hinge shield attached to the hinge pin, the combination of the hinge shield and hinge hook substantially totally covering the hinge pin.

5. The telephone network interface enclosure of claim 4 wherein the hinge shield is a snap fit on the hinge pin.

* * * * *